United States Patent [19]

Song

[11] Patent Number: 4,494,785

[45] Date of Patent: Jan. 22, 1985

[54] ADJUSTABLE HANDHELD ROUND SANDWICH HOLDER

[76] Inventor: Ho K. Song, 130 Arch St., #5, Redwood City, Calif. 94062

[21] Appl. No.: 505,835

[22] Filed: Jun. 20, 1983

[51] Int. Cl.[3] ..... A47J 47/14; B65D 5/24

[52] U.S. Cl. ..... 294/1 R; 229/DIG. 13; 294/25

[58] Field of Search ..... 294/1 R, 16, 25, 137, 294/149, 167, 169; 229/1.5 R, 16 R, 16 C, 21, 31 R, 41 R, 41 B, 41 A, 41 C, 87 F, DIG. 3, DIG. 13

[56] References Cited

U.S. PATENT DOCUMENTS

| | | | |
|---|---|---|---|
| 2,145,481 | 1/1939 | Harvey | 229/DIG. 13 |
| 2,367,675 | 1/1945 | Greenleaf | 294/1 R X |
| 2,444,116 | 6/1948 | Rossi | 294/1 R |
| 3,407,927 | 10/1968 | Jones | 294/25 X |
| 3,446,416 | 5/1969 | Epstein | 229/31 R |
| 4,189,054 | 2/1980 | Liu et al. | 229/DIG. 13 |

FOREIGN PATENT DOCUMENTS

| | | | |
|---|---|---|---|
| 1450683 | 9/1976 | United Kingdom | 294/25 |

*Primary Examiner*—Johnny D. Cherry

*Attorney, Agent, or Firm*—Frank Frisenda, Jr.

[57] ABSTRACT

The round sandwich holder is made of paperboard stock and has folded end sections which form open cup-like receptacles at either end of an elongated accordion-folding central body. The open cup-like ends are the handles to accommodate the insertion of a round sandwich, such as a hamburger. The bottom outside perimeter edge of the sandwich rests along the accordion-folding central body between the open cup-like ends. The accordion-folding central body is then adjusted to accommodate the diminishing bottom edge perimeter of the sandwich as the sandwich is consumed.

5 Claims, 6 Drawing Figures

ADJUSTABLE HANDHELD ROUND SANDWICH HOLDER

BACKGROUND OF THE INVENTION

At the present time, the general methods for handling round sandwiches are either a piece of finished light paper simply wrapped around the sandwich, or a carton-like container in which the sandwich is inserted. However, thses applications demonstrate problems regarding the comfortable enjoyment of the round sandwich by the consumer.

The paper wrapper becomes cumbersome when trying to eat a sandwich while also trying to prevent spillage of the sandwich contents on to the consumer. The wrapper is often ingested along with the food product when the consumer bites into the sandwich. And, after such an experience, the consumer often discards the paper wrapper entirely, and thereby becomes susceptable to the adverse effects of spillage from the sandwich contents.

In the case of the carton-like sandwich holder, its basic purpose becomes void after the first half of the sandwich is eaten, because the remaining portion of the sandwich must then be removed from the holder in order to allow for its consumption. Here again, the consumer becomes susceptible to the adverse effects of the spillage of the sandwich contents.

To overcome these shortcomings of the existing devices, the present invention is developed to be easily adjustable by the consumer so as to afford protection from any spillage of the sandwich contents throughout the consumption of the entire sandwich.

This invention is also so designed as to be easily utilized in conjunction with existing pre-formed outer packaging boxes for sandwiches.

SUMMARY OF THE INVENTION

The present invention is a device which is an adjustable hand-held food holder specifically designed to accommodate a round sandwich, such as a hamburger. It features an elongated central body having equally spaced accordion folds across its width and having either extended foldable tabs or arm-like appendages on either side and at either end of that central body. The tabs have adhesive applied to them in order to facilitate overlapping them in such a way as to have said tabs form an open cup-like receptacle at either end of the central body. Each of the arm-like appendages has an adhesive tab on the inside end which facilitates the formation of open cup-like receptacles, similar to those aforementioned, when the adhesive tabs are affixed to the central body.

Accordingly, it is an object of this invention to provide an economical handheld sandwich holder which can be employed to retain such round sandwiches as hamburgers for transfer at time of sale, and for the buyer to hold the sandwich during eating. It is a further object to provide a sandwich holder which has an accordion folded central body with open cup-like receptacles at either end, so as to easily allow for adjustment which would coincide with the diminishing perimeter of a round sandwich as it is eaten. It is still another object to provide an adjustable handheld sandholder made of paperboard stock and arranged so that it can be held in the hands so that the handheld sandwich holder can be economically employed for sanitary handling of round sandwiches.

The features of the present invention which are believed to be novel are set forth in particularity in the appended claim. The present invention, both as to its organization and the manner of operation, may best be understood by reference to the following description, taken in connection with the accompanying drawings.

DESCRIPTION OF THE PREFERRED EMBODIMENT

The adjustable handheld round sandwich holder of this invention is generally indicated at 1 in FIGS. 1*a*, 1*b*, 2*a*, 2*b*, 3*a* and 3*b*, having a heavy outer edge line generally indicated at 3 in FIGS. 1*a*, 1*b*, 2*a*, 2*b*, 3*a* and 3*b*. It can have overlapping foldable tabs with adhesive at either end, 2 in FIGS. 1*a*, 2*a* and 3*a*. The tabs on either side at either end are identical. They overlap one another, 7 in FIG. 2*a*, so as to form open cup-like receptacles after first being folded vertical to the elongated central body of this invention along the fold lines, 4 in FIGS. 1*a*, 2*a* and 3*a*. Similarly, the left and right ends are symmetrically identical so that either end may be held to the right of the user. Alternatively, arm-like appendages, 5 in FIGS. 1*b*, 2*b* and 3*b*, each having an adhesive tab, 6 in FIGS. 1*b* and 3*b*, can be utilized instead of the aforementioned foldable tabs. The arm-like appendages on either side at either end of the elongated central body are identical, and they are so shaped as to form open cup-like receptacles after first being folded vertical to the main body of this invention along the fold lines, 4 in FIGS. 1*b*, 2*b* and 3*b*, and then having the adhesive tabs, 6 in FIGS. 1*b* and 3*b* placed against the inside wall of the main body of this invention, 6 and 1 in FIG. 3*b*. Similarly, the left and right ends are symmetrically identical so that either end may be held to the right of the user.

Figure 1A:
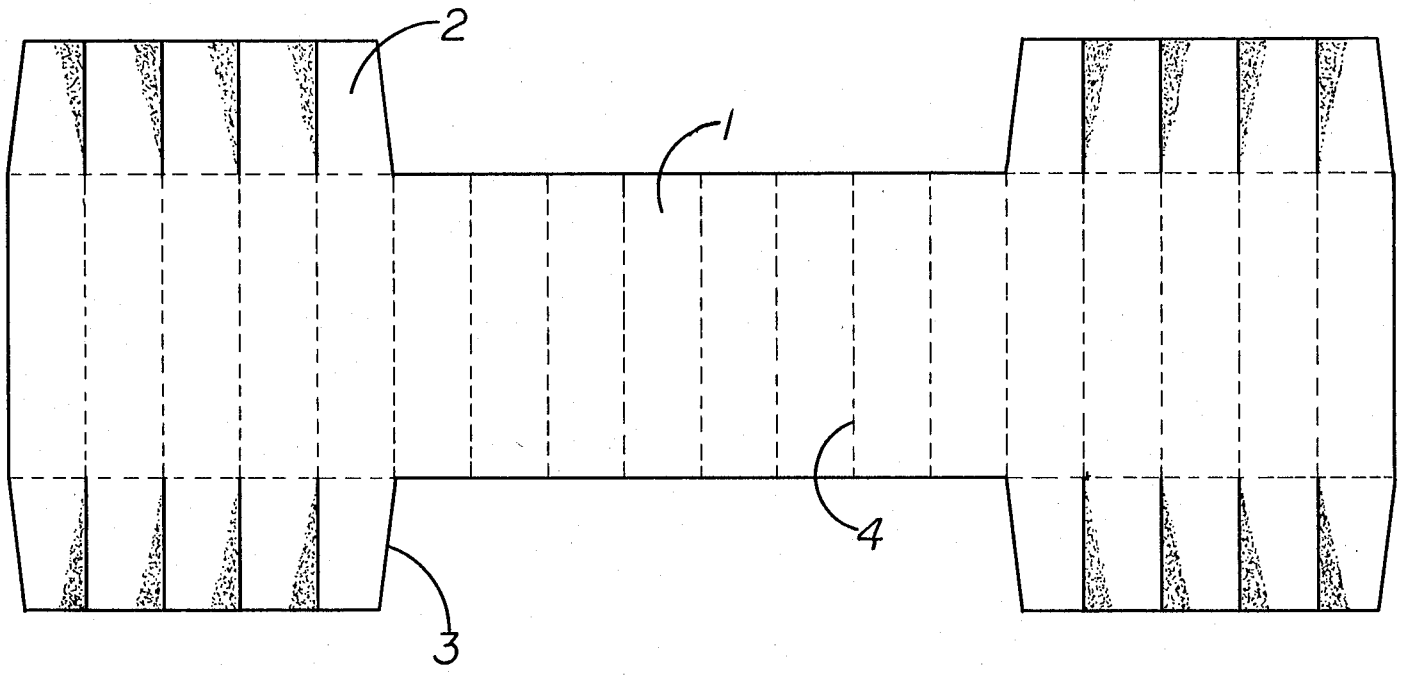
FIGS. 1*a* and 1*b* are plan views of paperboard blanks from which the adjustable handheld round sandwich holder of this invention is made.
Figure 2A:
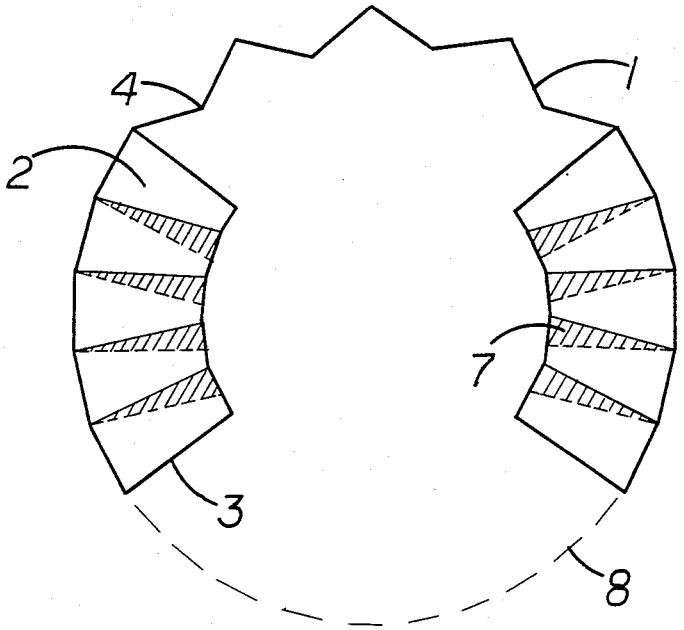
FIGS. 2*a* and 2*b* are inverted front views of the adjustable handheld round sandwich holder of this invention, showing it in its assembled condition with round sandwich articles therein.
Figure 3A:
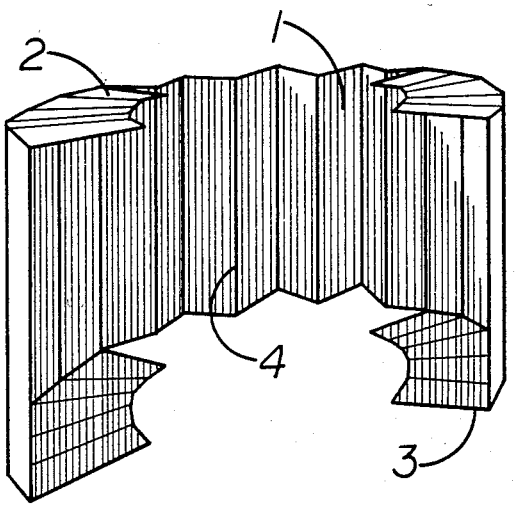
FIGS. 3*a* and 3*b* are perspective views of the adjustable handheld round sandwich holder of this invention, showing it in its assembled condition.
Figure 1B:
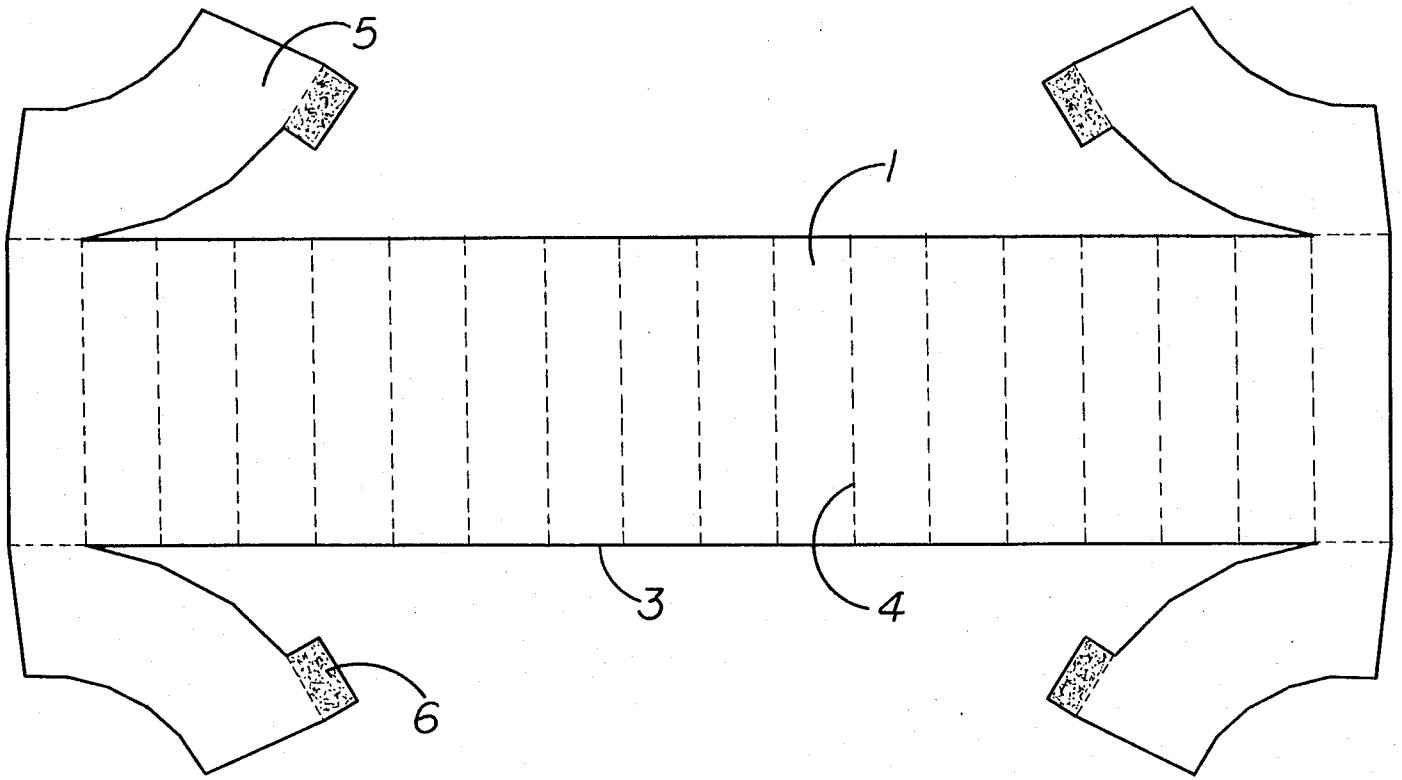
Figure 2B:
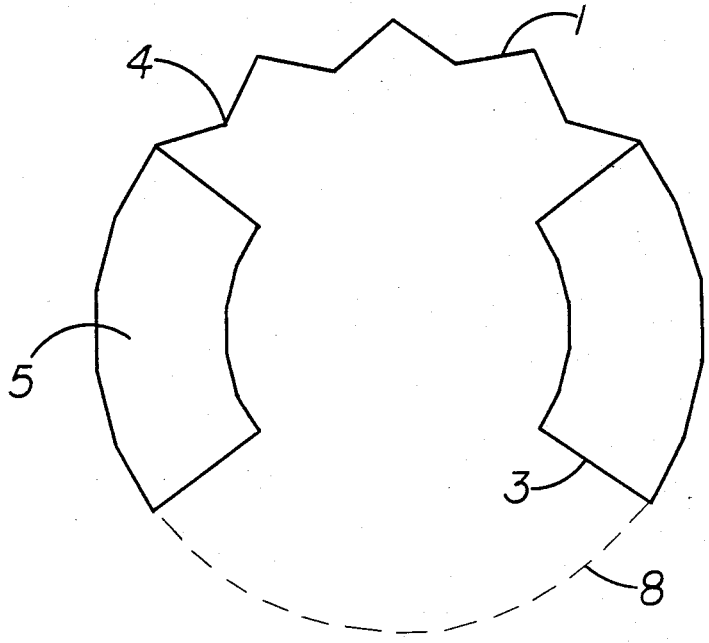
Figure 3B:
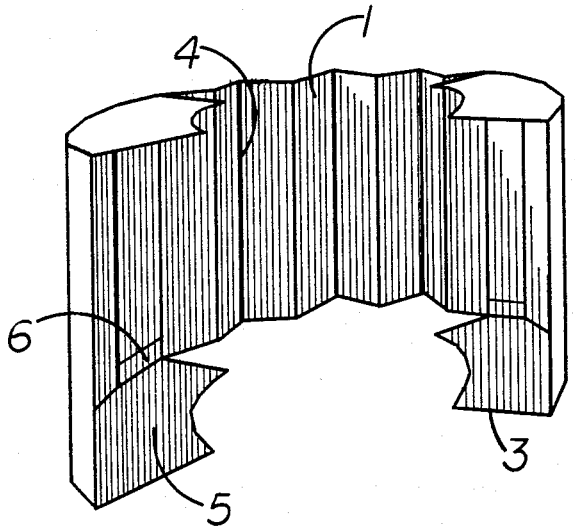

As seen in FIGS. 2*a* and 2*b*, 8 represents the outline of a round sandwich that has been enclosed by the adjustable handheld round sandwich holder.

As seen in FIGS. 1*a*, 1*b*, 2*a*, 2*b*, 3*a* and 3*b*, 4 indicated fold lines and their proximity to one another. The function of these lines, as located across the width of the elongated central body, is to allow for expansion and contraction along the perimeter of a round sandwich as it is being placed into the sandwich holder, and being eaten, respectively.

The length and width of the elongated central body of the adjustable handheld round sandwich holder are such that they may be varied to accommodate round sandwiches of differing thickness and circumference.

There are two significant and critical features of the layout and configuration of the round sandwich holder which make it particularly suitable to the task. The first critical feature is that the open cup-like receptacles at either end of the elongated central body, as shown in FIGS. *2a, 2b, 3a* and *3b,* are so designed as to afford maximum exposure of the food item during consumption while also eliminating direct contact with the food item by the consumer hands. Thusly, an accessible and sanitary means by which to eat the product is afforded to the consumer.

The second critical part of the arrangement and design is the fact that the elongated central body of the round sandwich holder has equidistant accordion folds across its width, as shown in FIGS. *2a, 2b, 3a* and *3b.* These folds allow for the systematic contraction of the open cup-like receptacle ends as the sandwich is being consumed, while still affording protection from sandwich content spillage.

These features, plus the fact that the adjustable round sandwich holder can be stamped from a single blank, as illustrated in FIGS. *1a* and *1b,* and assembled with a minimum of gluing, make the adjustable round sandwich holder an economic and highly desirable structure for employment in the handling and consumption of round sandwiches.

Accordingly, the present invention provides an adjustable hand held sandwich holder, the sandwich holder having an elongated central body, a left end portion and a right end portion, the end portions each being contoured with respect to one another, to form an open receptacle for enveloping and for receiving a circumferential portion of a sandwich placed therein;

the elongated central body comprising substantially parallel equidistant accordion fold lines transversely disposed to the longitudinal axis of said elongated central body;

the right end portion and the left end portion each comprising upper and lower appendages which extend substantially perpendicular from said elongated central body to envelope and to receive the circumferential portion of the sandwich;

the appendages each being composed of plural overlapping tab sections to form side walls of the open receptacle;

wherein the equidistant accordion fold lines of the elongated central body portion accommodate a systematic contraction of the right end portion and the left end portion as the sandwich is being consumed.

While particular embodiments of the present invention have been shown and described, it will be obvious to those skilled in the art that changes and modifications may be made without departing from this invention in its broader aspects, and, therefore, the aim in the appended claim is to cover all such changes and modifications as fall within the true spirit and scope of this invention.

I claim:

1. An adjustable hand held sandwich holder, said sandwich holder having an elongated central body, a left end portion and a right end portion, said end portions each being contoured with respect to one another, to form a open receptacle for enveloping and for receiving a circumferential portion of a sandwich placed therein;

said elongated central body comprising substantially parallel equidistant accordian fold lines transversely disposed to the longitudinal axis of said elongated central body;

said right end portion and said left end portion each comprising upper and lower appendages which extend substantially perpendicular from said elongated central body to envelope and to receive the circumferential portion of the sandwich;

said appendages each being composed of plural overlapping tab sections to form sidewalls of said open receptacle;

wherein said equidistant accordion fold lines of said elongated central body portion accommodate a systematic contraction of said right end portion and said left end portion as the sandwich is being consumed.

2. The adjustable hand held sandwich holder as defined in claim 1, wherein said plural overlapping tabs of said appendages are fabricated with adhesive tabs having distinct plural cuts to coincide with said parallel equidistant accordion fold lines disposed on said elongated central body.

3. The adjustable hand held sandwich holder as defined in claim 2 wherein said adhesive tabs are cut to coincide to at least five parallel equidistant accordian fold lines disposed on said elongated central body.

4. The adjustable hand held sandwich holder as defined in claim 1, where in said tabs are fabricated having folding segments to overlap one another and configured to form a side wall of an open receptacle for enveloping and for receiving a circumferential portion of the sandwich placed therein.

5. The adjustable hand held sandwich holder as defined in claim 1, said holder being fabricated from paper stock.

* * * * *